US006676573B2

(12) United States Patent
Abelbeck et al.

(10) Patent No.: US 6,676,573 B2
(45) Date of Patent: Jan. 13, 2004

(54) MULTIPLE FUNCTION EXERCISE DEVICE AND METHOD

(75) Inventors: Kevin G. Abelbeck, Los Angeles, CA (US); Lawrence S. Kaye, 10509 Laramie Ave., Chatsworth, CA (US) 91311

(73) Assignees: Lawrence S. Kaye, Chatsworth, CA (US); R. Steven Davidson, Van Nuys, CA (US)

( * ) Notice: Subject to any disclaimer, the term of this patent is extended or adjusted under 35 U.S.C. 154(b) by 419 days.

(21) Appl. No.: 09/871,426

(22) Filed: May 31, 2001

(65) Prior Publication Data

US 2002/0183173 A1 Dec. 5, 2002

(51) Int. Cl.[7] ..... A63B 21/068

(52) U.S. Cl. ..... 482/95; 482/100; 482/101; 482/121; 482/135; 482/139; 482/145

(58) Field of Search ..... 482/95, 96, 100, 482/101, 121, 125, 126, 129, 130, 131, 135–140, 142, 145

(56) References Cited

U.S. PATENT DOCUMENTS

| | | | | | |
|---|---|---|---|---|---|
| 3,622,154 | A | * | 11/1971 | Williams | 482/96 |
| 4,387,893 | A | * | 6/1983 | Baldwin | 482/137 |
| 4,600,196 | A | * | 7/1986 | Jones | 482/137 |
| 4,623,144 | A | * | 11/1986 | Rockwell | 482/137 |
| 4,915,378 | A | * | 4/1990 | Abrahamian et al. | 482/137 |
| 5,070,863 | A | * | 12/1991 | McArthur et al. | 601/26 |
| 5,201,694 | A | * | 4/1993 | Zappel | 482/133 |
| 5,336,149 | A | * | 8/1994 | Wang | 482/100 |
| 5,358,462 | A | * | 10/1994 | Calderone | 482/137 |
| 5,549,529 | A | * | 8/1996 | Rasmussen | 482/96 |
| 5,669,865 | A | * | 9/1997 | Gordon | 482/142 |
| 6,605,024 | B2 | * | 8/2003 | Stearns | 482/142 |
| 2002/0111257 | A1 | * | 8/2002 | Hur | 482/140 |

FOREIGN PATENT DOCUMENTS

| | | | | |
|---|---|---|---|---|
| SU | 1646557 | A1 | * 5/1991 | 482/96 |

* cited by examiner

*Primary Examiner*—Nicholas D. Lucchesi
*Assistant Examiner*—Victor Hwang

(57) ABSTRACT

This is a multiple function exercise device that enables simultaneous exercise of several muscle groups. The device includes a chest pad that is stationary to the support frame and a seat that moves in a path of motion that enables the user's chest to remain on the chest pad as the user's legs are extended, thereby causing movement of the seat. This combination provides activation of the leg and hip extensor muscles and the trunk flexor muscles at the same time. In another embodiment, a resistance arm is added that is pivotally attached to the frame and mechanically linked to the seat, thereby causing movement of the arm as the seat moves. This allows the additional activation of the triceps muscles, or elbow extensors of the upper arm, while also working the leg and hip extensor muscles and the trunk flexor muscles all in a single movement. The advantage to such a movement is the time saving effect of working a large group of muscles at one time as opposed to several exercises one after the other.

30 Claims, 7 Drawing Sheets

MULTIPLE FUNCTION EXERCISE DEVICE AND METHOD

BACKGROUND OF THE INVENTION

The invention herein relates to an exercise device and more particularly to exercise devices that allow for work done concurrently by multiple muscle groups. This multiple function capability has an advantage in the time saving effect of working a large group of muscles at one time as opposed to several exercises one after the other. The busy schedules of the users are of utmost importance in any physical activity to promote physical health. Few people will or can spend and hour or more in the gym each day. A minimal 30-minute cardiovascular workout followed by 30–40 minutes of weight training doesn't even allow for a quick bite on the way back to the office.

As more and more individuals work out of their homes, the need for fitness products that are usable in a home setting become more desirable. One of the necessities of a home piece of fitness equipment is in the versatility or variety of exercises that can be done given a specific space requirement of the device. A single device that performs a variety of exercises is very desirable in this respect. If the device also enables two or more exercises to be accomplished in a single composite movement, the device solves both the time and space considerations that would otherwise prevent many users from participating in a fitness program.

Most health club products are not as sensitive to space as in the home market. As such, traditional health club facilities greatly rely on single function equipment, that is a device that works a particular muscle group. Though health club facilities are obviously dedicated to equipment placement and usage, unlike a home, but the space allotment still has associated costs including building rent. Therefore it is advantageous in many cases to provide equipment that has multiple uses. Traditionally these are generalized devices such as jungle gyms, racks for free weights and linear motion smith machines. Still these are not intended to perform seemingly unrelated movements in unison to save time for the user.

SUMMARY OF THE INVENTION

Present Invention

In one aspect, the invention features a frame with a chest pad that is supported by the frame, and may be movably mounted to the frame and a seat that is movably supported on the frame. The seat is mounted such that when it moves relative to the frame, while supporting the pelvic region of a user, the path of motion of the seat enables the chest region of the user to maintain contact with the chest pad. The device may include a resistance arm, which is pivotally mounted to the frame and in mechanical communication with the seat.

The mechanical communication of the resistance arm may include a substantially rigid drive link with a first end pivotally mounted to the seat and a second end pivotally mounted to the resistance arm. An alternative form of mechanical communication includes a flexible tension member such as any of an item selected from the group consisting of a wire rope, a rubber belt, a Kevlar belt and a nylon rope.

The system may also include more than one form of mounting to the frame. The seat may be pivotally mounted to the frame. This may be done by use of two substantially rigid links each with one end pivotally mounted to the frame and each with a second end pivotally mounted to the seat. These links are likely pivotally mounted to the frame in such a way that there is not a common axis and also pivotally mounted to the seat without a common axis. The seat may also be slidably mounted to the frame.

The device may also include a foot support that is mounted on the frame, preferably moveably mounted. In the preferred embodiment the foot support is slidably mounted to the frame by use of a female tube that is mounted directly to the frame, which receives a male tube that is mounted directly to the foot support. This may also include a lock to releasably secure one to the other.

Additional resistance may also be applied to the user during exercise. This may be accomplished by use of one or more elastic bands or weight plates that are releasably secured to any moving element of the device.

In another aspects, the invention includes a method of providing an exercise device, which includes the detail as previously disclosed, positioning the pelvic region of the user in the seat and the chest region on the chest pad. The user then extends their legs while applying force to the chest pad, in combination, to move the seat. This concurrently exercises the extensor muscles of the lower body and the flexor muscles of the trunk of said user. This method can also be expanded where the exercise device further includes a resistance arm that is previously disclosed, and then further includes the step of extending the arms of the user, thereby also concurrently exercising the elbow extensor muscles of the user.

Definition of Terms

Unless otherwise defined, all technical and scientific terms used herein have the same intended meaning as would be commonly understood by anyone of ordinary skill in the art to which this invention belongs. To eliminate possible ambiguity, specific terms used herein have been defined, as they would be applied to the present invention.

An "elbow extensor" is any muscle serving to cause an increase in the joint angle of the elbow or extend the lower arm from the upper arm. This muscle group is also referred to as the triceps or triceps brachii which is the large muscle situated along the back of the upper arm.

A "hip extensor" is any muscle serving to cause an increase in joint angle of the hip as measured from the anterior aspect of the body within the sagittal (vertical longitudinal) plane. This muscle group is referred to as the gluteus muscles or in common form the buttocks.

A "leg extensor" is any muscle serving to increase the joint angle of the knee or ankle as measured from the anterior aspect of the body for the ankle and the posterior aspect of the body for the knee. Both are measured within the sagittal (vertical longitudinal) plane. The ankle extensors include the more superficial gastrocnemius muscle and soleus muscle positioned directly deep relative to the gastrocnemius. The knee extensors include quadriceps muscle which is a large muscle located on the anterior aspect of the thigh. This muscle is a generic term covering the vastus lateralis, vastus medialis, vastus intermedius and the rectus femoris.

BRIEF DESCRIPTION OF THE DRAWINGS

The foregoing and other objects of this invention, the various features thereof, as well as the invention itself, may be more fully understood from the following description, when read together with the accompanying drawings, as described.

For the most part, and as will be apparent when referring to the figures, when an item is used unchanged in more than one figure, it is identified by the same reference indicator in all figures.

DETAILED DESCRIPTION OF THE PREFERRED EMBODIMENT

The object of the disclosed invention is to provide an improved device and method for enabling exercise of multiple muscle groups in a single movement on a single machine. In this invention, the muscle groups include the elbow extensors, trunk flexors and the hip, knee and ankle extensors each individually or any combination thereof.

Figure 1:
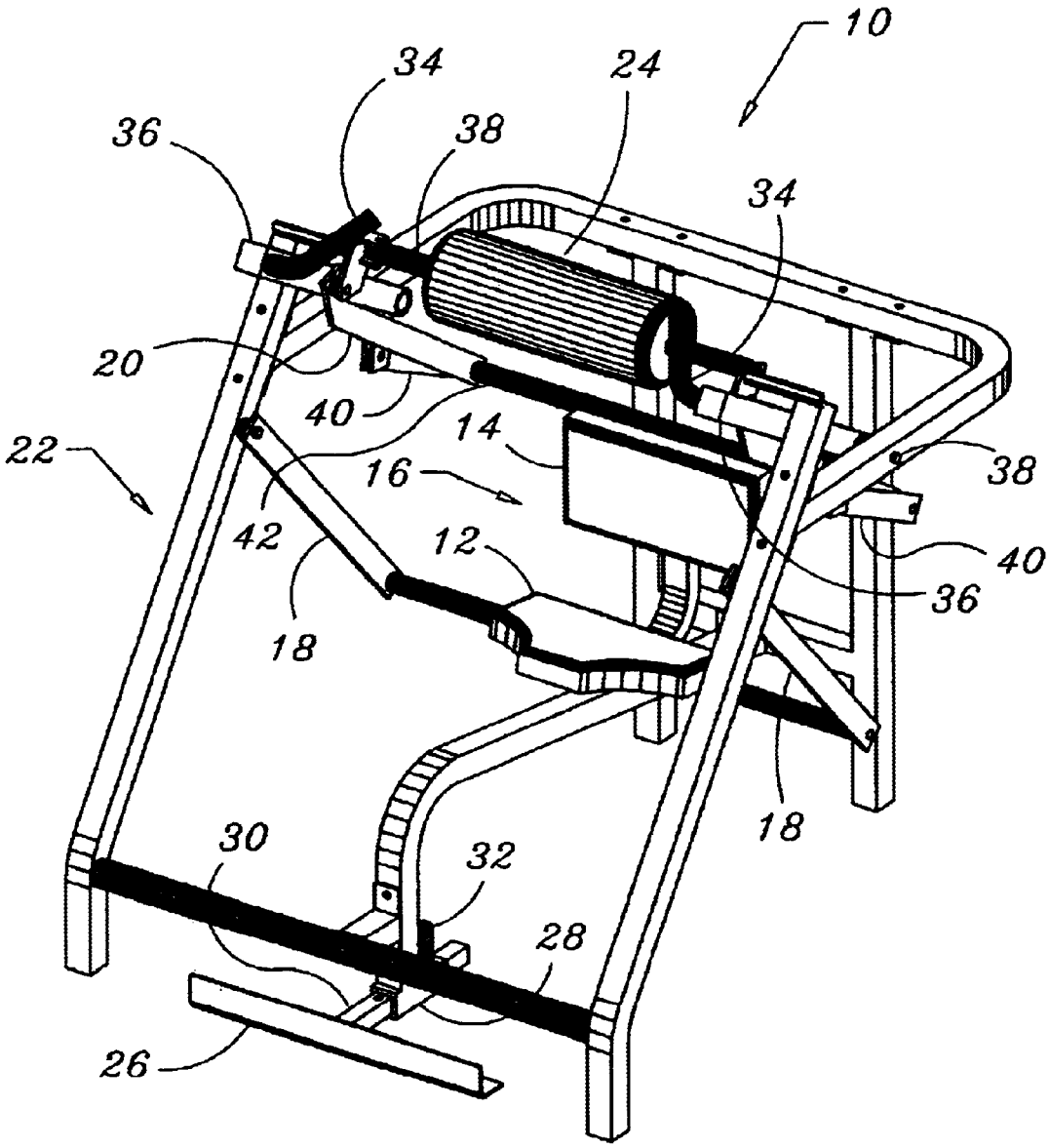
FIG. 1 is an isometric view of an exercise device produced in accordance with a preferred embodiment of the present invention.

What is shown in FIG. 1 is an isometric view of a multiple function exercise device 10. An upper front side view shows a bottom seat 12, a back seat 14, which in combination, comprises the seat 16 of the device. The seat enables at least partial support of a user at the lower torso of the user. The seat 16 is supported by a pair of lower links 18 at the lower portion and a pair of upper links 20 at the top portion of the seat 16. These upper links 20 and lower links 18 are pivotally mounted to the seat and the frame 22 of the device.

A chest pad 24 is positioned above the seat 16 and is so positioned to engage the chest of the user when the user is positioned on the seat 16. The chest pad 24 remains stationary to the frame 22 while the device is in use. This offers a reactive force to the user when a force is applied by the user to the pad. When this force is applied to the pad 24, by the chest of the user, the resultant action is a rearward movement of the seat 16. The positioning of the links 18 & 20 mandate an upward movement of the seat 16 with this rearward movement. The upward component of the seat 16 and with it at least partial body weight of the user, results in work done by the abdominal muscles of the user.

A foot plate 26 is mounted to the frame 22 and can be done so in a variety of ways. In many applications it is desirable to movably mount the foot plate 26. This is done here by use of a female tube 28 that is rigidly mounted to the frame 22 and a male tube 30 that is rigidly mounted to the foot plate 26. The male tube 30 is received by the female tube 28. This allows the foot plate 26 to move relative to the frame 22 while maintaining support due to the presence of the telescoping male 30 and female tubes 28. A lock 32 such as a spring loaded pin, screw pin or any other locking device known in the art can be used to releasably secure the foot plate 26 in various positions relative to the frame 22.

The foot plate 26 is used to provide resistance for the user to push against, thereby extending the legs of the user and moving the seat 16 in an upwardly and rearward motion. This motion is similar to that as previously described in that the seat 16 follows a predetermined path relative to the frame 22. As previously noted, the upward movement of the seat 16 and associated body weight of the user, results in work done by the user. In this case the extensor muscles of the lower body are doing the work. It is also possible to exercise both the legs and the abdominal muscles by concurrently flexing the trunk as the user's chest is pressed against the pad 24 while the user's feet push against the foot plate 26. Both movements causing vertical displacement of the seat 16 and therefore doing work.

A third aspect to the invention 10 is obtained by use of the handles 34. The handles 34 are rigidly mounted to arms 36, which are movably mounted, and in this case, pivotally mounted to the frame 22 at a pivot shaft 38. Rotation of the handle 34 and resulting arm 36 causes movement of a push link 40, which is pivotally mounted to the seat 16 at the rod 42, which also supports the upper arm 20. This common placement was accomplished by repeated iteration and analysis of the linkage combination and seat 16 movement. This common pivot design is desirable for manufacturing simplicity and aesthetic appreciation, but is not necessary for the function of the invention.

When the handles 34 are rotated about the pivot shaft 38, down toward the seat 16, the push link 40 causes rearward and therefore upward movement of the seat 16. Again, this seat 16 movement is as previously described. The positioning of the handles 34 and the relative placement of the pivot shaft 38 enables the hands of the user to remain in contact with the handles 34 as the user is seated in the seat 16. As such, the user can extend at the elbows while seated in the seat 16. The vertical movement of the body weight of the user provides resistance to the elbow extensors, thus exercising those muscles.

As stated previously, the seat of the device moves relative to the frame in a similar manner regardless of the mode of displacement used; pressing against the chest pad 24; pushing against the foot plate 26; or pushing down on the handles 34. The elbow extensor (triceps) muscles can be exercised alone by movement of the handles 34. The leg extensor muscles or trunk flexor (abdominal) muscles can also be exercised alone or in combination by the movements as previously noted. The triceps can be exercised concurrently with the legs or the abdominals or all three can be exercised at the same time. The user decides by how much, if any, pressure is placed on each of the handles 34, foot plate 26 and chest pad 24, separately or in any combination. In doing so, the user's workout is infinitely variable and can conform to the amount of emphasis the user places of each exercise movement aspect of the device 10.

Figure 2:
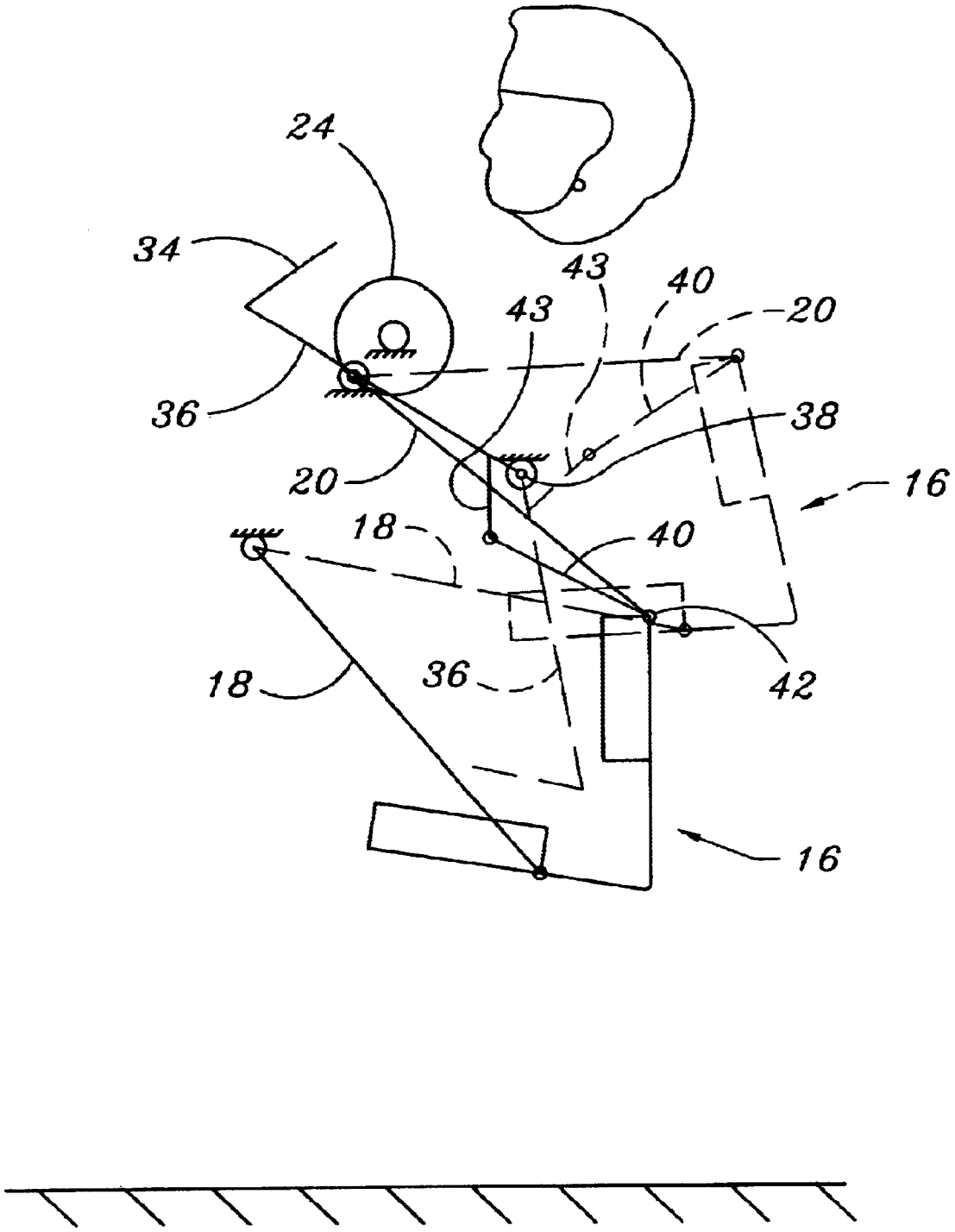
FIG. 2 is a side schematic view showing a bottom and a top position of an exercise device produced in accordance with the preferred embodiment of the present invention.

To more explicitly detail the linkage of the preferred embodiment, a schematic of the linkage is shown in FIG. 2. The handle 34 is connected to the arm 36, which is pivotally mounted to the frame by pivot shaft 38. An arm extension 43 provides a support for the push link 40. The other end of the push link 40 and the one end of the upper link 20 are pivotally mounted to the upper portion of the seat 16 at the rod 42. The lower link 18 also supports the seat 16. Downward movement of the handle 34 and arm 36 results in an upward movement of the seat 16, as illustrated by the elevated (top position) of the seat 16.

Figure 3:
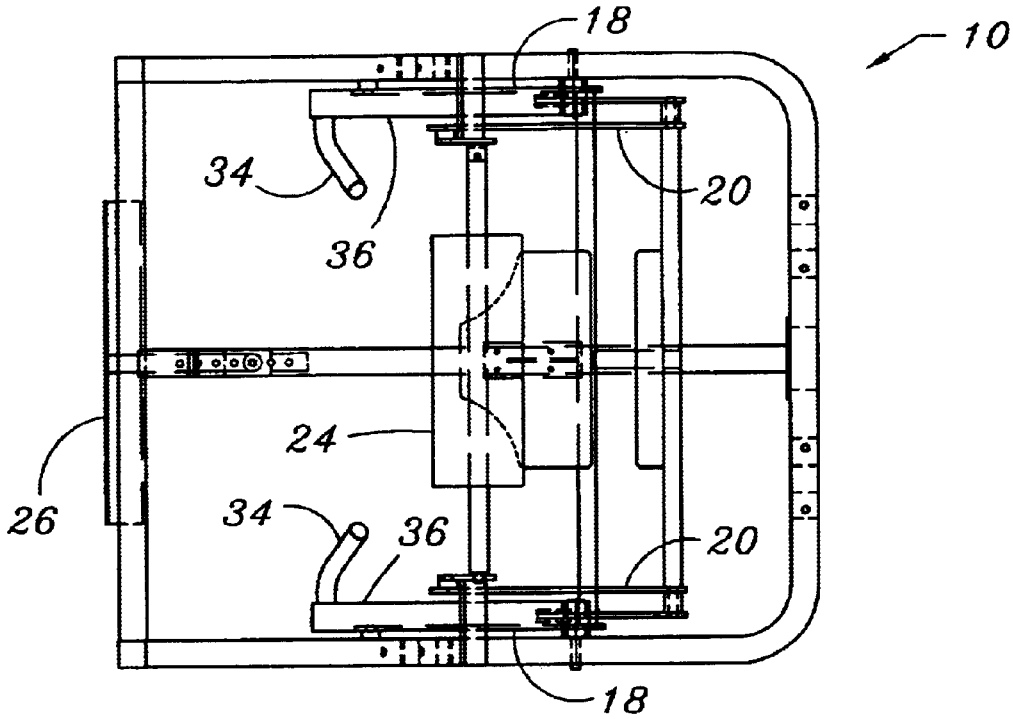
FIG. 3 is a top view of an exercise device produced in accordance with a preferred embodiment of the present invention.
Figure 4:
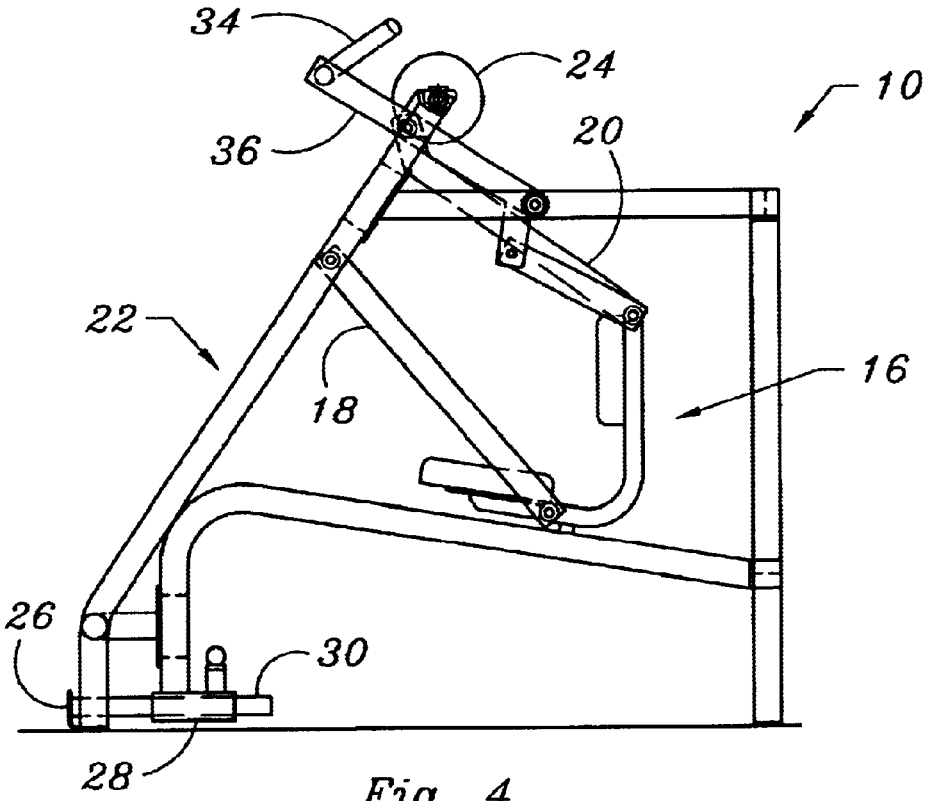
FIG. 4 is a side view of an exercise device produced in accordance with a preferred embodiment of the present invention.

More detail of the device 10 is shown in the top view in FIG. 3 and the side view in FIG. 4. The general positioning of the device 10 can be seen in these views. The user's body fits between the handles 34 and attached arms 36 and is positioned on the seat 16 with the body in a traditional seated position. The user's chest is positioned against the chest pad 24 and hands upon the handles 34. This constitutes the starting position of the device 10.

Figures 5A, 5B, 5C:
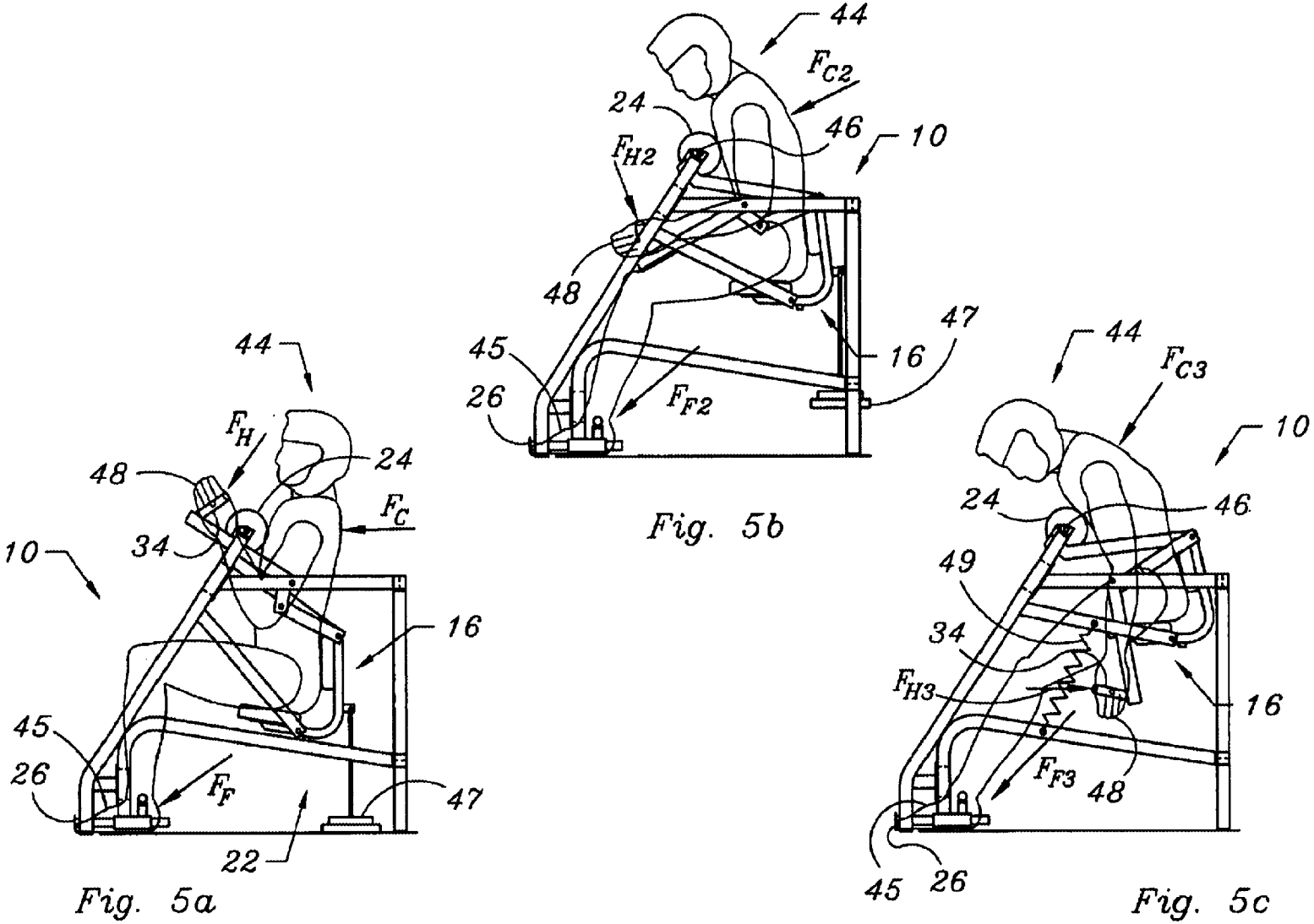
FIG. 5 is a three-part side view sequence of an exercise device showing the starting, middle and final positions of an exercise device produced in accordance with the present invention.

Movement of the device 10 is illustrated in FIG. 5. Here, FIG. 5*a* shows the starting position, as has been depicted thus far in the previous figures. A middle position of the device 10 in use is shown in FIG. 5*b* and a final or top position is shown in FIG. 5*c*. A simulated body 44 is used to show how the device 10 would typically be used. Typically, when the device 10 reached a top position, as illustrated in FIG. 5*c*, the user would reverse the direction of movement and descend back to the position of FIG. 5*b* and then to FIG. 5*a*. The process would then be repeated as desired by the user.

In the starting position, FIG. 5*a*, the body 44 is positioned on the seat 16 with the chest against the chest pad 24. The feet 45 of the body 44 are positioned against the foot plate 26 and the hands 48 on the handles 34. Forces can then be applied by any, all or any combination of body parts of the user to actuate the seat 16 to a higher position as illustrated in FIG. 5*b*.

These forces applied by the body 44 are illustrated by force vectors $F_F$ as applied by the feet 45 against the foot plate 26; $F_C$ as applied by the chest against the chest pad 24 and $F_H$ by the hands 48 against the handles 34. A force applied by the feet ($F_F$) results in an extension of the legs of the user to move the seat 16 and a portion of the weight of the user 44 from the starting position in FIG. 5*a* to the middle position of FIG. 5*b* and finally to the final position shown in FIG. 5*c* with little change in the orientation of the force as the movement continues ($F_{F2}$ to $F_{F3}$).

Like the foot plate 26, while in use, the chest pad 24 remains stationary to the frame 22 of the device 10. The force applied ($F_C$) causes a substantially horizontal reaction force in the first position. This force ($F_{C2}$) becomes more vertical in orientation in the middle position as the body is elevated and the trunk flexes. This direction change of the force ($F_{C3}$) continues even more as the body 44 is further elevated to the top position. The pad 24 is intentionally round from the side view to accommodate slight misalignments of the body 44 with the machine caused by variations in trunk height and trunk flexibility of individual users. This is desirable, but not mandatory, in that the inventors have found that in application, the device yields a minimal change in position of chest contact of the body 44 relative to the pad 24 during the movement, regardless of user stature, age or sex.

It is important that the chest of the user is capable of maintaining contact with the pad 24 throughout the range of the movement. That can be accomplished in two ways, either the pad is able to articulate relative to the chest (pad rolls on chest) or for optimal comfort of the user, allow the pad 24 to move relative to the frame 22 (pad roll on machine). In normal use of the device 10, and in ideal placement of the chest pad 24 relative to the body 44, no translation of the chest of the body 44 relative to the pad 24 occurs, but the direction of the chest force vector ($F_C$) changes as the body 44 moves. It has been determined most desirable to enable the chest pad 24 to rotate about an axis bar 46. This allows the contact of the pad 24 with the chest of the user to remain constant as the pad 24 rotates about the axis bar 46. The structure of the axis bar 46 provides the structural integrity to enable the reaction force associated with the forces applied by the chest against the pad 24. This happens as the chest moves relative to the frame 22, but not the pad 24, even as the force vector changes in direction from $F_C$ to $F_{C2}$ to $F_{C3}$.

As a user's strength increases it may become desirable to add resistance beyond the body weight of the user. This is illustrated in two ways. FIG. 5*a* shows a weight plate 47 attached to the seat 16. As the exercise movement is performed, the weight plate 47 is elevated by the upward movement of the seat 16, as provided by the user. FIG. 5*b* shows this elevated position of the weight plate 47. In a similar fashion, an elastic band 49 can be mounted between any frame member of the device 10 and the seat 16 or any other moving part. This is illustrated in FIG. 5*c*. As the seat 16 moves during the exercise, the elastic cord 49 is stretched. This increase in tension in either method results in increased work done by the user.

Figure 6:
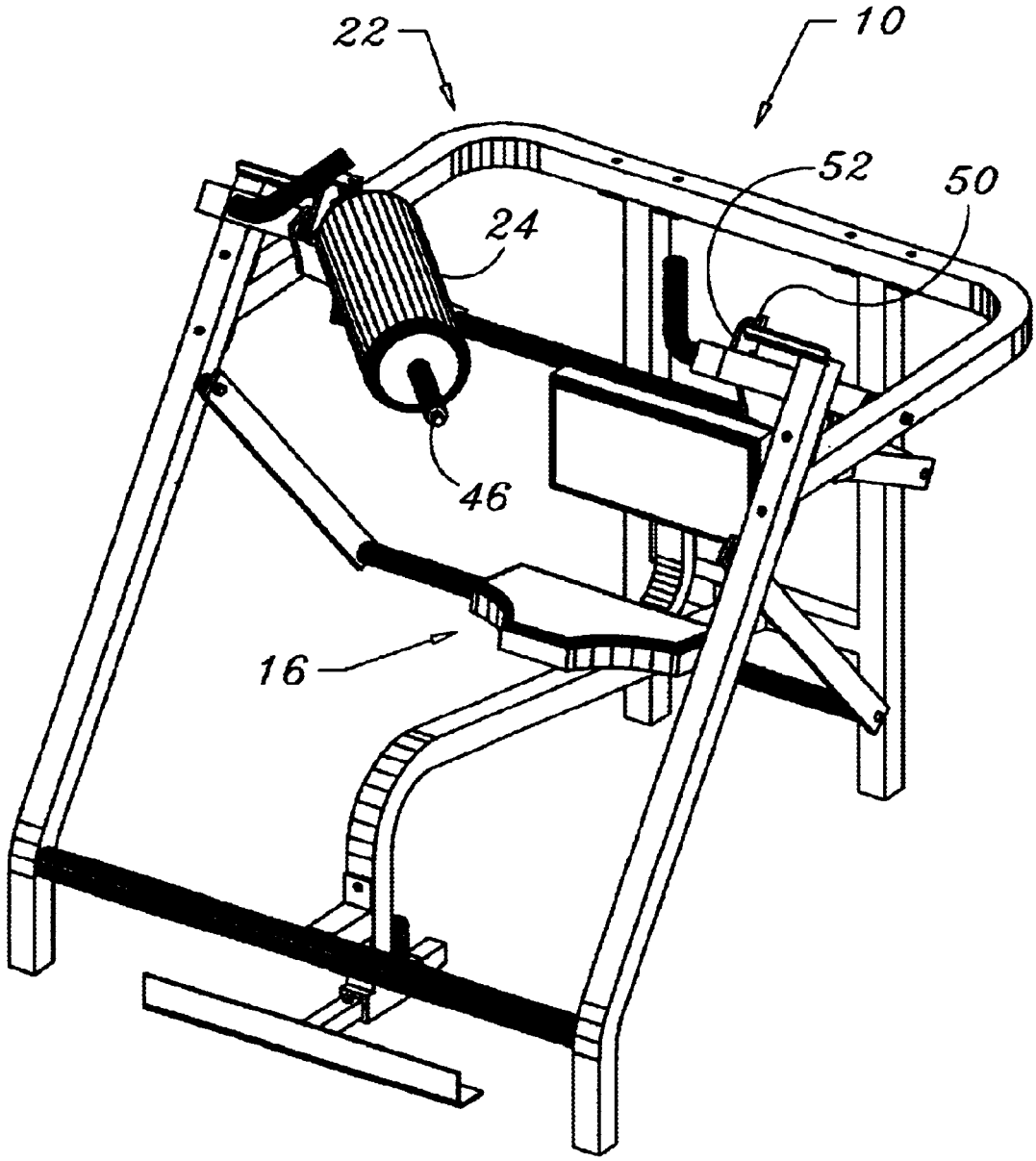
FIG. 6 is an isometric view of an exercise device with the chest pad rotated to allow entrance to the user, the device produced in accordance with the present invention.

Any exercise device is only of value if the user is able to use it. The device 10 is shown in FIG. 6 to show one method of entry into the device 10. The chest pad 24 is supported on the axis bar 46, which is movably mounted on the frame 22. This is can be done in a variety of ways, in that the object is to allow the user to gain access to the seat 16. In the preferred embodiment, the axis bar 46 is pivotally mounted to the frame 22 along an axis that is substantially vertical. In this way the bar 46, and accompanying pad 24 can rotate away from the opposite side of the frame 22, thereby opening a space for the user. To secure the bar 46 in place, a notch 50 is placed in the support mount 52. This notch 50 is capable of receiving the end portion of the bar 46, thereby releasably securing it to the frame 22.

Figure 7:
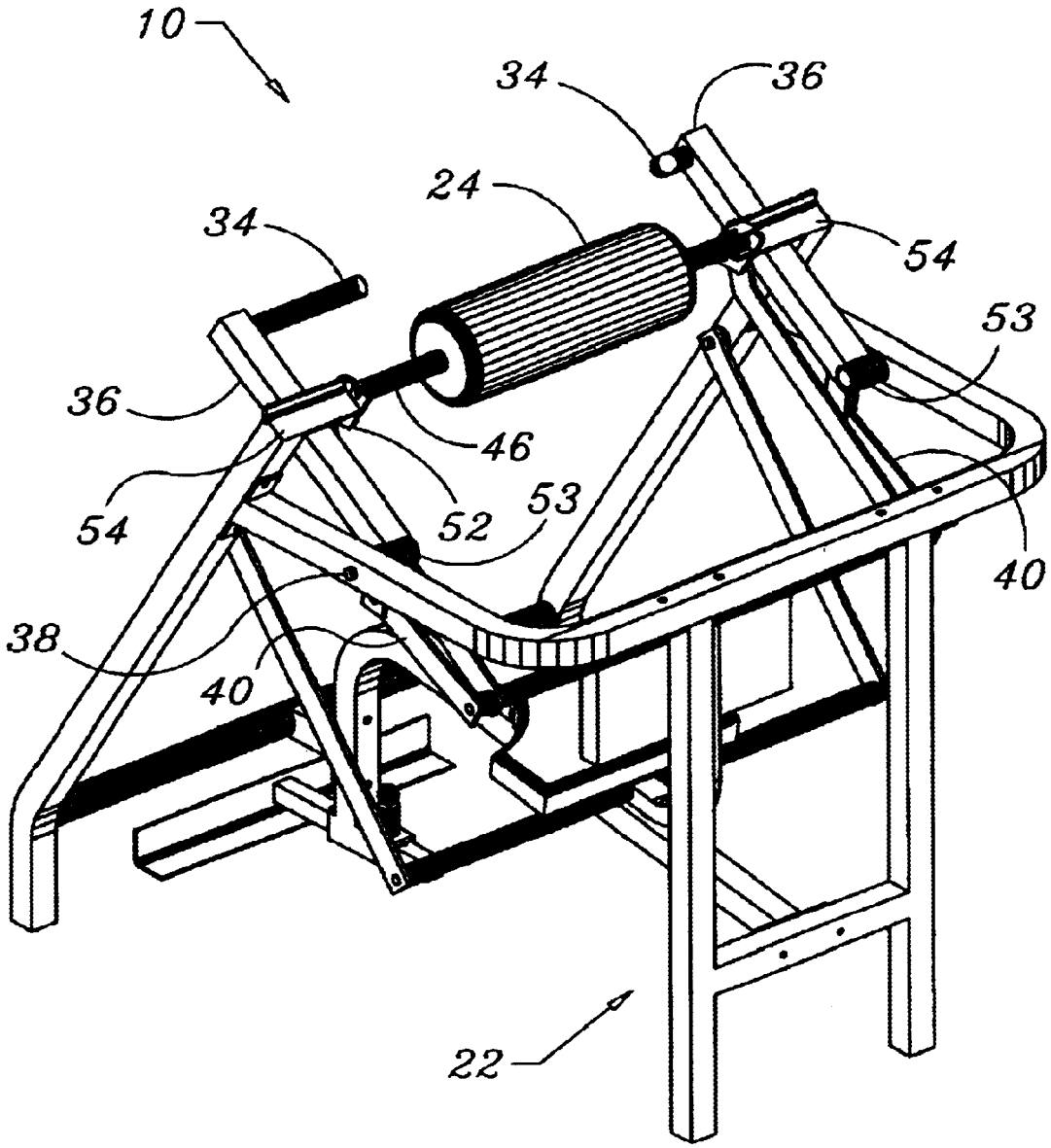
FIG. 7 is an isometric view of and exercise device as shown from the rear of the machine, the device produced in accordance with the present invention.

An upper rear view of the device 10 is shown in FIG. 7. This shows more detail of the structure of the arms 36 in the preferred embodiment. The handles 34 attach to the arms 36 and are supported by the frame 22 at a bearing 53. This bearing 53 rides on the pivot shaft 38. The arms 36 have an upward stop in the upper brace 54. This brace 54 has two functions. The most obvious is the upward stop of the arms 36, thus preventing them from being pulled up excessively and potentially injuring the user or over centering the articulating push link 40. The second function is the support of the support mount 52. This enables the support mount 52 to be positioned inside of the arms 36 and yet supported by the frame 22, which is generally on the outside of the arms 36.

Figure 8:
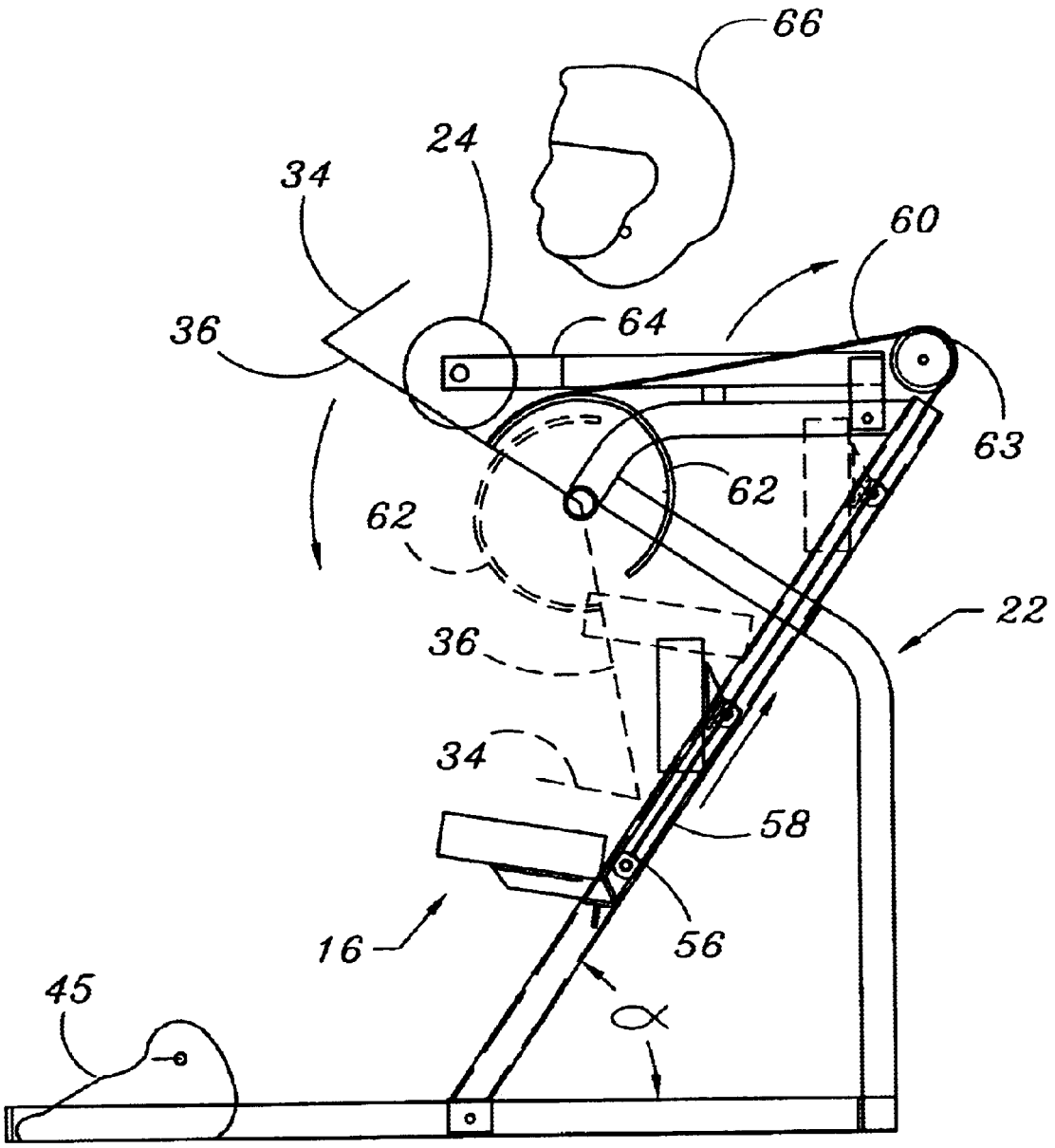
FIG. 8 is a side view of an exercise device showing an alternative tracking mechanism for the seat, drive mechanism for the arms and entrance mechanism, the device produced in accordance with the present invention.

A modified version of the invention is shown in FIG. 8. A handle 34 is attached to an arm 36, which as in the previous figures, is pivotally mounted to the frame 22. The seat 16 is now supported on the frame 22 by wheels 56 that ride in a track 58, the track being mounted to the frame 22. Movement of the seat 16 along the track 58 is enabled by a cord 60 that is connected to the seat 16 and a cam 62, which is in turn connected to the arm 36. Thus, movement of the arm 36 results in movement of the cord 60. The cord 60 is guided by a pulley 63 and directed along the track 58 to the seat 16.

The angle (alpha) denotes the angle of the track 58 with respect to the horizontal. This angle is critical, within a range, in that if the angle is to great the vertical component will be to great and the user's chest will not maintain contact with the pad 24 during the movement of the seat 16. If the angle is to low, a similar problem will ensue only in the opposite direction. An optimal angle was determined by the inventor to be 56.5 degrees. A preferable range has been determined to be between 51 and 62 degrees as denoted by the angle alpha.

Also in this figure, an alternative movement of the chest pad 24 is shown. This again is done to allow entrance to the seat 16 by the user. Here, instead of a pivotal mount on the side of the frame, a chest pad arm 64 is used to support the chest pad 24 and this arm 64 is pivotally mounted to the frame 22 behind the user's head 66. This allows the chest pad 24 and the arm 64 to be raised over and back of the user, opening the space for the user to enter and exit the machine.

It is to be understood that a number of combinations are possible in regarding the lengths and positions of the linkages to enable seat 16 movement while maintaining chest contact with the pad 24 and providing constant contact of the user's hands with the handles 34. The attached drawings are scaled versions depicting only two versions.

Additional load can be used on any version of the invention by adding additional weight plates to any moving part, especially the seat 16. Another variation would be to use elastic cords that are anchored to the frame 22. The cords can be anchored to resist vertical movement of the seat 16 or assist this movement. This can be accomplished in an infinite number of ways, including mounting a cord to the seat and anchoring it to the frame below or above the seat to add or subtract resistance, respectively or in the form of a torsion spring on any rotating joint.

In addition, the enclosed information is presented as the preferred embodiment as seen by the inventors. An infinite number of variations and modifications can be made including various forms of additional force (load) application, framework design and linkage arrangements. Both a pivoting and a linear tracking mechanism are disclosed and within each of those designs also exists an infinite number of design variations.

What is claimed is:

1. A multiple function exercise device comprising:

a frame;

a chest pad supported by said frame; and a seat movably supported on said frame such that when the seat moves relative to said frame and said chest pad, while supporting the pelvic region of a user, the path of motion of the seat enables the chest region of said user to maintain contact with said chest pad.

2. The device as described in claim 1, wherein said seat is pivotally mounted to said frame.

3. The device as described in claim 2, wherein said seat is pivotally mounted to said frame by two substantially rigid links each with one end pivotally mounted to said frame and each with a second end pivotally mounted to said seat.

4. The device as described in claim 3, wherein said two substantially rigid links are pivotally mounted to said frame without a common axis and pivotally mounted to said seat without a common axis.

5. The device as described in claim 1, further comprising an inclined track mounted to said frame and said seat is received thereby, thus being slidably mounted to said frame.

6. The device as described in claim 5, wherein said inclined track is set and an angle of between 51 and 62 degrees with respect to the horizontal.

7. The device as described in claim 1, further comprising a foot support mounted on said frame.

8. The device as described in claim 7, wherein said foot support is movably mounted on said frame.

9. The device as described in claim 8, wherein said foot support is slidably mounted to said frame by use of a female tube mounted to said frame which receives a male tube that is mounted to said foot support, and a lock to releasably secure one to the other.

10. The device as described in claim 1, further comprising a loading device, which provides additional resistance to a user during exercise.

11. The device as described in claim 10, wherein said loading device is a device selected from the group consisting of an elastic band and a weight plate.

12. The device as described in claim 1, wherein said chest pad is mounted to an arm that is moveably mounted to said frame.

13. The device as described in claim 1, further comprising a resistance arm that is capable of being engaged and articulated by a hand of said user, the arm being movably mounted to said frame and in communication with said seat.

14. A multiple function exercise device comprising:

a frame;

a chest pad supported by said frame;

a seat movably mounted on said frame such that when the seat moves relative to said frame and said chest pad, while supporting a user, the path of motion of the seat enables the chest region of said user to maintain contact with said chest pad; and a resistance arm movably mounted to said frame and in mechanical communication with said seat.

15. The device as described in claim 14, wherein said mechanical communication includes a substantially rigid drive link with a first end pivotally mounted to said seat and a second end pivotally mounted to said resistance arm.

16. The device as described in claim 14, wherein said mechanical communication includes a flexible tension member.

17. The device as described in claim 16, wherein said flexible tension member is an item selected from the group consisting of a wire rope, a rubber belt, a Kevlar belt and a nylon rope.

18. The device as described in claim 14, wherein said seat is pivotally mounted to said frame.

19. The device as described in claim 18, wherein said seat is pivotally mounted to said frame by two substantially rigid links each with one end pivotally mounted to said frame and each with a second end pivotally mounted to said seat.

20. The device as described in claim 19, wherein said two substantially rigid links are pivotally mounted to said frame without a common axis and pivotally mounted to said seat without a common axis.

21. The device as described in claim 14, further comprising an inclined track mounted to said frame and said seat is received thereby, thus being slidably mounted to said frame.

22. The device as described in claim 21, wherein said inclined track is set and an angle of between 51 and 62 degrees with respect to the horizontal.

23. The device as described in claim 14, further comprising a foot support mounted on said frame.

24. The device as described in claim 23, wherein said foot support is movably mounted on said frame.

25. The device as described in claim 24, wherein said foot support is slidably mounted to said frame by use of a female tube mounted to said frame which receives a male tube that is mounted to said foot support, and a lock to releasably secure one to the other.

26. The device as described in claim 14, further comprising a loading device, which provides additional resistance to a user during exercise.

27. The device as described in claim 26, wherein said loading device is a device selected from the group consisting of an elastic band and a weight plate.

28. The device as described in claim 14, wherein said chest pad is mounted to an arm that is moveably mounted to said frame.

29. A method of providing a multiple function exercise including the steps of:

providing an exercise device which includes, a frame;

a chest pad supported by said frame; and a seat movably supported on said frame such that when the seat moves relative to said frame, while supporting a user, the path of motion of the seat enables the chest region of said user to maintain contact with said chest pad;

positioning the pelvic region of said user in said seat and the chest region on said chest pad;

extending the legs of said user and applying force to said chest pad in combination to move the seat, thereby concurrently exercising the extensor muscles of the lower body and the flexor muscles of the trunk of said user.

30. The method as described in claim 29, wherein said exercise device further includes a resistance arm movably mounted to said frame and in mechanical communication with said seat, and also further including the step of extending the arms of said user, thereby also concurrently exercising the elbow extensor muscles of said user.

* * * * *